United States Patent [19]

Politze et al.

[11] 3,953,989

[45] May 4, 1976

[54] METHOD AND APPARATUS FOR WARP KNITTING AND RESULTANT PRODUCT

[75] Inventors: Walter Politze; Wolfgang Wunsch, Karl-Marx-Stadt, Germany

[73] Assignee: VEB Wirkmaschinenbau, Karl-Marx-Stadt, Germany

[22] Filed: Aug. 21, 1974

[21] Appl. No.: 499,348

[52] U.S. Cl. ..... 66/84 A

[51] Int. Cl.[2] ..... D04B 23/06; D04B 23/08; D04B 23/10; D04B 23/12

[58] Field of Search ..... 66/85 A, 85, 84 A, 84, 66/86, 87, 190, 192, 191; 28/1

[56] References Cited

UNITED STATES PATENTS

| | | | |
|---|---|---|---|
| 3,446,038 | 5/1969 | Inui | 66/84 |
| 3,564,872 | 2/1971 | Klaeui | 66/85 A |
| 3,665,732 | 5/1972 | Doring et al. | 66/84 |

*Primary Examiner*—Ronald Feldbaum
*Attorney, Agent, or Firm*—Nolte and Nolte

[57] ABSTRACT

In a fabric constituted lengthwise of stitched warp threads and, transverse thereto, an array of weft threads substantially parallel to one another, the array of weft threads is in the form of repeating sections, each section comprises a plurality of discrete portions of weft threads and each discrete portion extends in a continuous line at least twice from one lateral border of the fabric to the other lateral border of the fabric and forms a U at at least one of the borders of the fabric. This fabric is made by a method and with an apparatus in which the weft threads are transferred to two feeding means which transport the weft threads to a zone in which warp threads are stitched into the array of weft threads, the transferring being effected by a weft layer which moves between the feeding means transversely to the direction of motion of the feeding means and, at selected intervals, parallel to the direction of motion of the feeding means.

11 Claims, 13 Drawing Figures

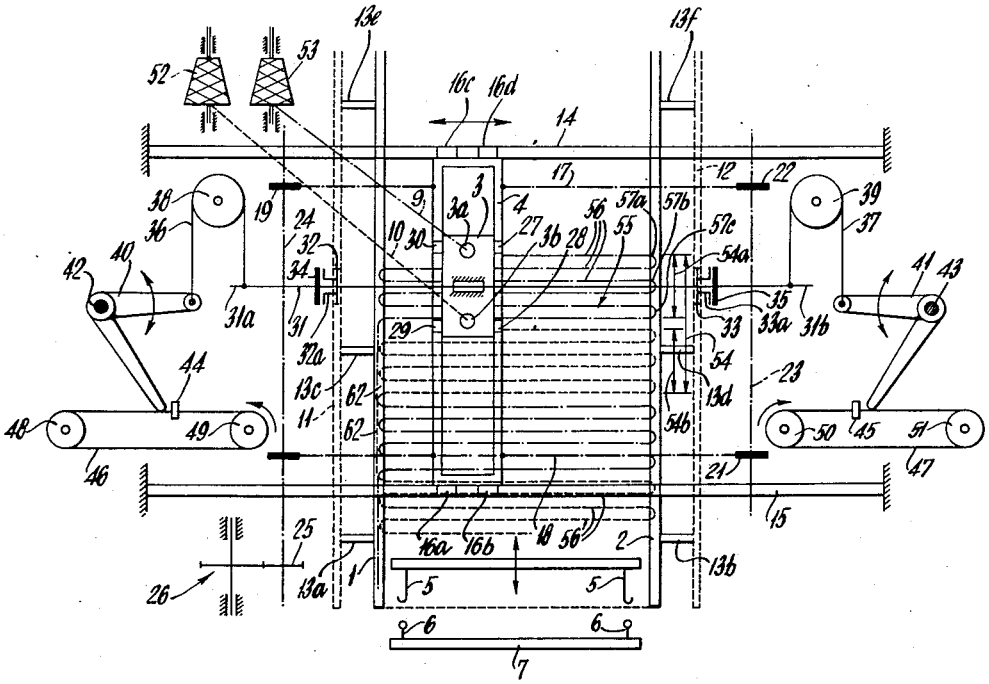

3
60
59
58
B
2
1

3
60
59
58
C
2
1

3c
3
3d
A
B
3e
60
59
58
B
2
1

3
60
59
58
C
2
1

1
2
3
60
59
58
62
62
62
A
60
56
61

1
2
3
60
59
58
D
60
56
61a
61b
61c
A
61
D 1
2
3
60
59
58
62
62
62
61
56
B 1
2
3
60
59
58
B
62
62
62
61
56

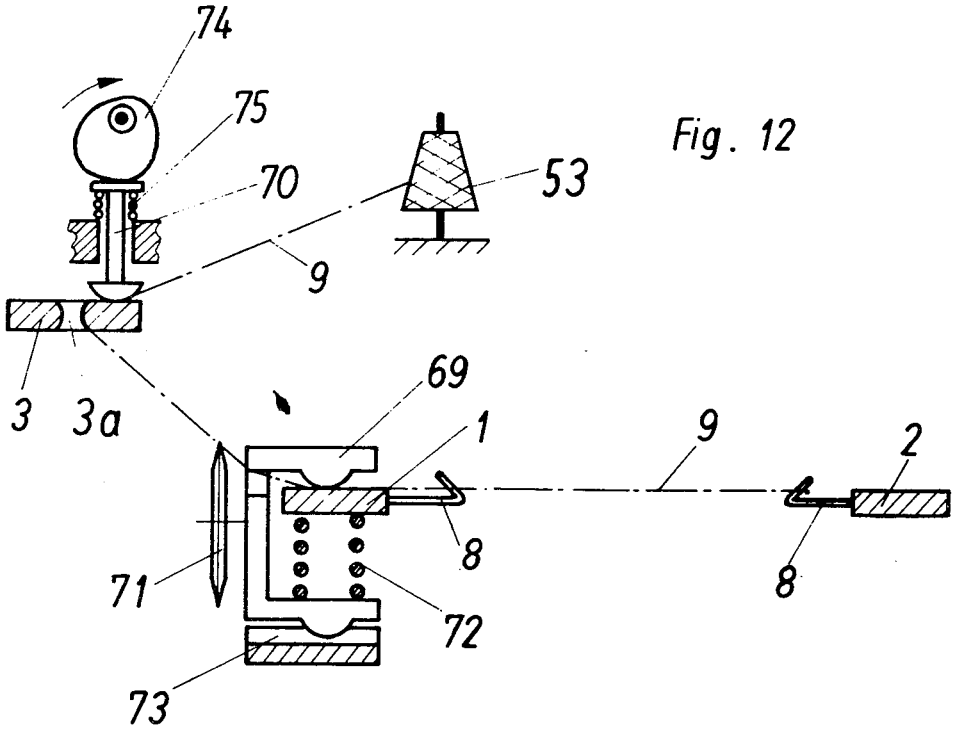
Fig. 12
Fig. 13
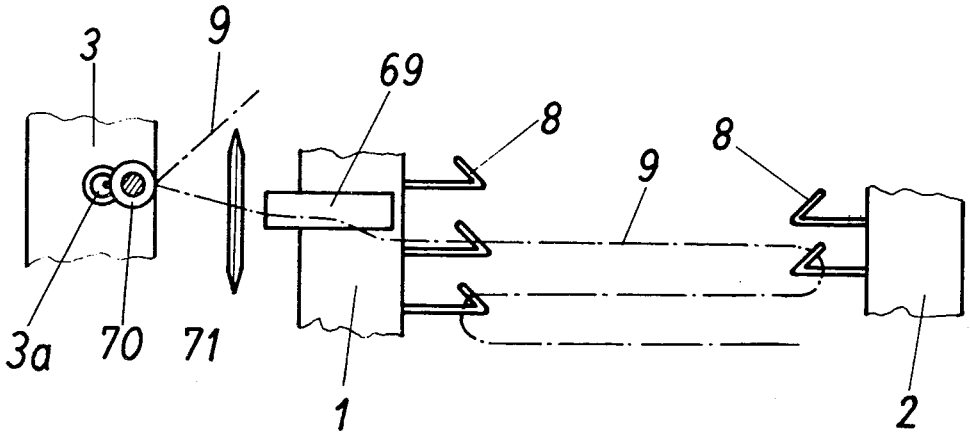

METHOD AND APPARATUS FOR WARP KNITTING AND RESULTANT PRODUCT

This invention relates to a method of and apparatus for making fabric, involving knitting, particularly warp knitting, including tricot knitting, and the resultant fabric.

Warp knitting of the so-called "weft-warp" type is known in which one group of parallel weft threads is worked substantially transversely to the length of the knitting. It is also known in such knitting to provide that the group of weft threads form a sequence or series which is composed of individual weft sections which, in turn, can be divided into individual weft portions. In addition, corresponding methods and machines are known in which the weft threads are transferred to feeding means by means of a weft layer moving back and forth between the feeding means and the weft threads are subsequently fed to the stitch-forming zone of a warp knitting machine, the resultant combination of the wefts with the stitches forming a web.

In another known method and apparatus, the individual weft sections arranged in the finished warp knit fabric are constituted of weft portions which are laid as simple weft sections from one lateral margin of the fabric to the other. The weft construction of this fabric is by means of the weft layer moving back and forth between two feeding means. During this back and forth movement, the weft layer advances in the direction of motion of the feeding means in order that the transverse weft threads be distributed along the fabric. Specifically, after the weft layer has covered the path between the feeding means, the weft layer moves parallel to the feeding means in order to effect a connection to the last laid weft section. After the weft layer has covered the path between the feeding means, the weft layer moves parallel to the feeding means but opposite to the direction of motion thereof so that the weft group is displaced by the width of the group plus one thread interval. Then the weft layer moves toward the opposite feeding means, advancing again in the direction of motion of the feeding means. When the weft layer has passed the opposite feeding means, it receives rearward movement relative to the direction of motion of the feeding means in order to effect the displacement of the weft group. By repeating the cycle as often as desired, the sequence of weft sections is formed. The adjoining weft sections are fed to a stitch-forming zone and the individual weft portions thereof are combined into a web by means of a plurality of parallel rows of stitches or warp knit stitch loops. The weft layer together with its direct driving elements is arranged in a device moving back and forth and thus runs in a repeatable cycle from the left to the right and from the right to the left as well as forward and backward. In this type of formation of the sequence of weft sections, there occurs a high weft stress in carrying out the displacement from one section to the next. Consequently, high stress peaks appear in the weft. This frequently leads to thread breaks or to a decrease in the rate of feed of the weft sections to the stitch-forming zone, which results in an unsatisfactory output of the machine. Moreover, this method limits variations in patterns which may be formed.

In the present invention, the aforementioned problems, particularly peaks in the stress on the weft threads, are avoided.

According to the invention, each weft portion traverses the fabric width at least twice whereby it includes at least one U-shaped segment of thread at at least one of the lateral borders of the fabric. Such a fabric is produced by feeding the weft threads to the feeding means side-by-side in at least two thread intervals of the warp knit fabric and forming them into the aforementioned simple U-shaped configurations at the borders of the fabric until each interval between the supplied weft threads inside the feeding means is filled and by displacing the weft threads thereafter opposite to the direction of take-off of the fabric from the machine. This cycle is repeated.

The apparatus is characterized in that eyelets occupied by weft threads are arranged on the weft layer the spacing between which eyelets corresponds to at least two thread intervals of the finished warp knit fabric. The weft layer is coupled during the reciprocal movement between the feeding means with the feeding means in order that the weft layer perform a movement with the feeding means in the direction toward the stitch-forming zone. The weft layer is independent of the feeding means between each reciprocating movement so that the feeding means overtakes the weft layer by a certain amount. The weft layer can be displaced between selected reciprocating movements in the direction away from the stitchforming zone.

The effect of the invention is that the stress peaks occurring during the displacement of the weft layer or of the weft group in the direction toward the stitch-forming zone are reduced in their absolute amount because the path of the weft layer is smaller than the length of a weft section. Consequently, the number of weft breaks is reduced by the invention and the working speed can be increased. The creation of more favorable stress ratios in the production of the knit fabrics results in a more uniform, distortion-free product which, moreover, is cheaper and may contain patterns of a greater variety.

The invention will now be described more fully by reference to specific embodiments as illustrated in the drawings, in which:

FIG. 12 is a schematic sectional view of the FIG. 1 embodiment on a different scale and in which the apparatus is equipped for the production of the warp knit fabric of FIG. 11;

FIG. 13 is a plan view corresponding to FIG. 12.

Figure 1:
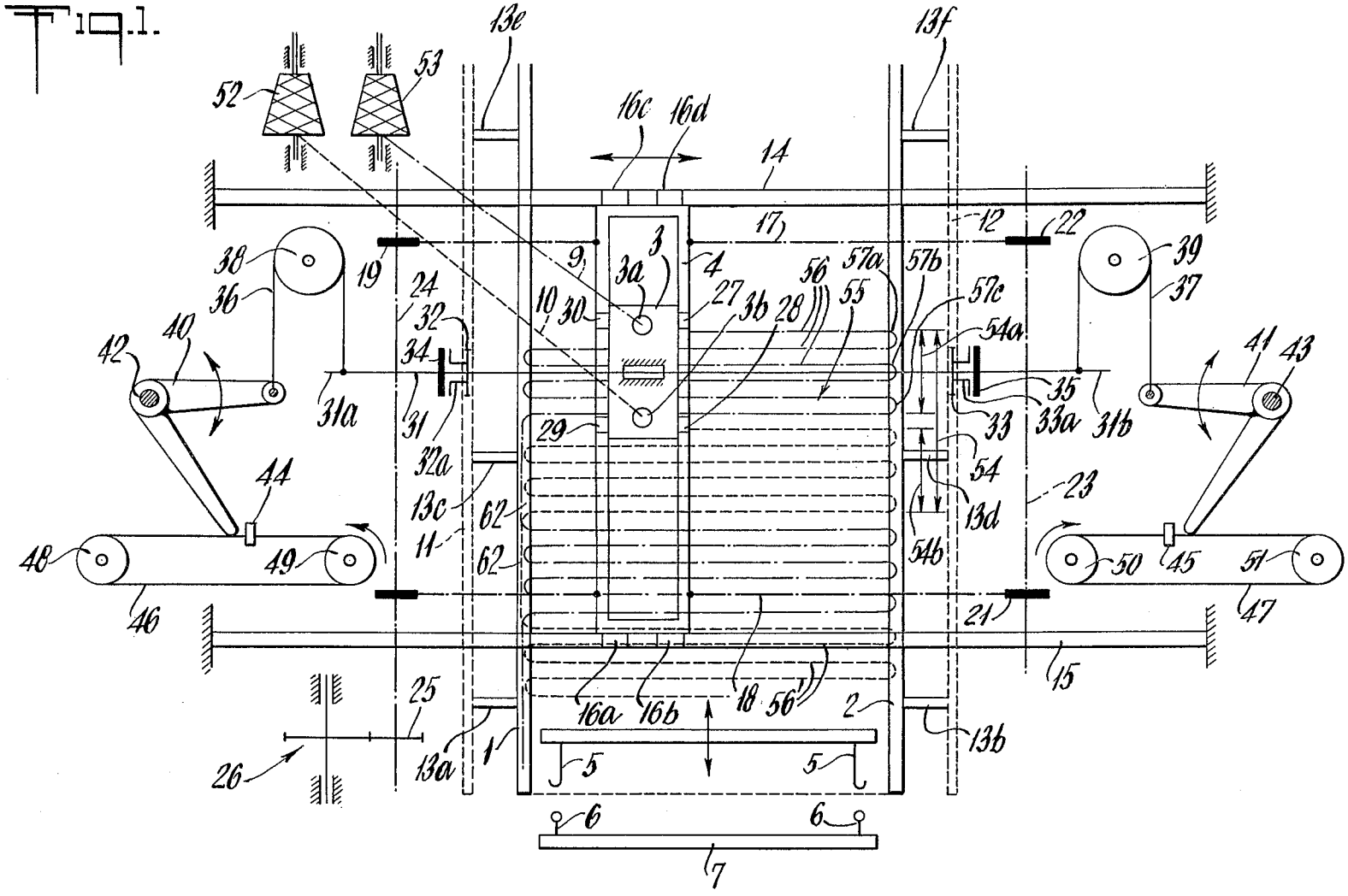
FIG. 1 is a schematic plan view of an apparatus according to the invention in which is being formed a fabric according to the invention.

The apparatus includes a weft layer 3 which is movable forward and backward on a slide 4 which slide 4 is, in turn, movable back and forth between feeding means 1, 2, a row of knitting needles 5 and eye-needles 6 which cooperate with the knitting needles 5 (FIG. 1). A group of warp threads (not illustrated) is drawn through the needles 6. The warp threads are inserted into the hooks of the knitting needles 5 due to a movement of an eye-needle bar 7 which corresponds, for example, to a horizontal eight, in order to produce simple chains of warp knit stitches of the tricot type. Several eye-needle bars 7 can be provided as is customary in warp knitting or tricot knitting machines. Apart from the portions of the machine which shall hereinafter be described specifically, the machine corresponds in basic construction to a warp knitting or tricot knitting machine and, accordingly, descriptions of those portions of the machine shall be omitted.

Conveyor chains 11, 12 are coupled to the feeding means 1, 2. On the feeding means 1, 2 are provided hooks 8 (FIGS. 12, 13) for holding the weft threads 9, 10. Connecting the conveyor chains 11, 12 to the feeding means 1, 2 are elements 13*a, b, c, d, e, f.* The conveyor chains 11, 12 extend parallel to the feeding means 1, 2 and are held a distance from the feeding means 1, 2. The slide 4 rests on two slide bars 14, 15 which extend transverse to the feeding means 1, 2 and above the feeding means and which are held stationary on the machine frame. In order that the slide 4 be mobile, it is provided with rollers 16*a, b, c, d.* For the imparting of reciprocal movement to the slide 4 transverse to the feeding means 1, 2, respective moving chains 17, 18, respectively, are secured next to each end face of the slide 4. The chains 17, 18 run over sprocket wheels 19 to 22 and are deflected by them so that a portion of the path of each chain 17, 18 extends under the slide 4. The sprocket wheels 19 to 22 are arranged on rotating shafts 23, 24. A change gear 26 is connected to shaft 24 over a gear wheel 25 secured thereon, with sets shaft 24 in alternating rotations. The change gear 26 can be, for example, a known cross loop drive (West German Offenlegungschrift No. 1,951,389) by means of which shaft 24 first performs a number of clockwise rotations so that the slide 4 is moved by the chains 17, 18 from feeding means 1 to feeding means 2. The shaft 23 with its sprocket wheels 21, 22 is driven by the chains 17, 18. When the slide 4 reaches the feeding means, the direction of rotation of the shaft 24 is reversed in order to move slide 4 back to the other side. Slide 4 can run back and forth between the feeding means 1, 2 with the necessary reversal taking place.

The weft layer 3 is arranged on the slide 4. By means of rollers 27 to 30 the weft layer 3 can move parallel to the direction of motion of the slide 4 and parallel to the feeding means 1, 2 or transverse to the direction of motion of the slide 4 and transverse to the feeding means 1, 2. The various possible movements of the slide 4 and weft layer 3 mean that longitudinal and transverse laying of the wefts 9, 10 can be effected alternately. The extent of a weft segment parallel to the feeding means 1, 2 can be varied to create different patterns, but the extent of transverse laying is determined by the distance between the feeding means 1, 2. The motion of the weft layer 3 in the direction of motion of the slide 4 is effected by means of bar 31 which is connected to the weft layer 3 and extends transversely to the direction of motion of the slide 4. The bar 31 carries between its ends 31*a*, 31*b* in proximity to the conveyor chains 11, 12 sprocket wheels 32, 33. The sprocket wheels 32, 33 rotate loosely on the bar 31 and are provided with coupling flanges 32*a*, 33*a*. The coupling flanges 32*a*, 33*a* are arranged on the side of each chain wheel 32, 33 which faces the ends 31*a*, 31*b*, respectively, of the bar 31. For non-rotationally securing the chain wheels 32, 33 to the bar 31, magneto-couplings 34, 35 rigidly connected to the bar 31 are provided. Secured to the ends 31*a*, 31*b* are tackles 36, 37 which are each conducted over a respective fixed roller 38, 39 and which couple the bar 31 to angle levers 40, 41. The angle levers 40, 41 pivot about bearings 42, 43. The pivoting movement is effected both by the tackles 36, 37 and by the cams 44, 45. The cams 44, 45 are carried by endless revolving chains 46, 47 the support and guidance of which is effected by sprocket wheels 48 to 51, each chain 46, 47 being driven by a pair of sprocket wheels. As illustrated in FIG. 1, chain 46 moves counterclockwise and chain 47 moves clockwise.

The operation of the apparatus is as follows. Due to the reciprocating movement of weft layer 3 between the feeding means 1, 2, the wefts 9, 10, which are withdrawn from bobbins 52, 53 and guided in the eyelets 3*a*, 3*b*, are transferred to the feeding means 1, 2 so that the feeding means 1, 2 retain the wefts 9, 10. The mechanisms of the apparatus are so timed relative to each other that the weft layer 3 lays the wefts 9, 10 six times transversely between the feeding means 1, 2 before a displacement of the weft layer 3 is effected opposite to the direction of motion of the feeding means 1, 2. The weft sections 54 of the sequence 55 formed of the wefts 9, 10 each consist of two endless weft portions 54*a*, 54*b* with each weft portion 54*a*, 54*b* extending in the form of connected weft lines 56 six times from one border of the knit fabric to the other and three simple U configurations 57*a*, 57*b*, 57*c* at a border of the fabric. During its movement between the feeding means 1, 2 the weft layer 3 receives a forward movement which corrresponds to the path covered by the feeding means 1, 2 during this period of time. The forward movement of the weft layer 3 is effected by the connecting of the sprocket wheels 32, 33 to the bar 31 by means of the couplings 34, 35 so that the conveyor chains 11, 12 propel the weft layer 3 forward toward the stitch-forming zone. When the weft layer 3 reaches a position in which the eyelets 3*a*, 3*b* are above the feeding means 1, 2, the couplings 34, 35 are disengaged from the chain wheels 32, 33 in order that the latter be freely rotatable. Consequently, the weft layer 3 no longer moves with the feeding means 1, 2. The weft layer 3 is permitted to remain in its rest position until the feeding means 1, 2 have advanced by one thread interval. Then, the couplings 34, 35 are connected to the sprocket wheels 32, 33 with the bar 31 in order that the weft layer 3 move forward at the speed of the feeding means 1, 2. During this advance movement, the weft layer 3 reciprocates between the feeding means 1, 2 to lay the wefts 9, 10 transversely to the feeding means 1, 2. When the weft layer 3 reaches the feeding means 1 or 2 and the formation of the weft section 4 is thus completed, to the weft layer 3 is imparted a movement opposite to the direction of motion of the feeding means 1, 2 such that the weft 10 is connected to the last laid weft line 56 of the weft 9, taking into account one thread interval.

The cams 44, 45 always reach the angle levers 40, 41 when the displacement movement of the weft layer 3 is to be started and carried out. By means of the cams 44, 45, the angle levers 40, 41 are thus turned in directions following the movement of the cams 44, 45 so that the tackles 36, 37 move the bar 31 with the weft layer 3 in the direction opposite to the feeding means 1, 2. The sprocket wheels 32, 33 roll off the conveyor chains 11, 12 and the magneto couplings 34, 35 are opened. When the cams 44, 45 have passed by the angle levers 40, 41, the displacement movement is completed and the reciprocating movement of the weft layer 3 between the feeding means 1, 2 begins again. The weft layer 3 is again carried forward in steps and the angle levers 40, 41 are returned again into their starting position through the tackles 36, 37.

The displacement of the weft layer 3 opposite to the direction of motion of the feeding means 1, 2 corresponds to the path which it covers together with the feeding means 1, 2 during the formation of a weft section 54. If to the sum of the thread intervals of the weft section 54 is added one thread interval and subtracted the number of thread intervals of a weft portion 54*a*, 54*b*, the size of the displacement is obtained. Accordingly, the displacement can be reduced relatively by increasing the number of weft intervals per weft portion 54*a*, 54*b*. In practice, a displacement path can be obtained which is almost fifty percent of the length of the weft section 54. According to the invention, the size of the displacement may be selected. Another feature of the invention is that each individual thread is always laid at least twice back and forth between the feeding means 1, 2 before the weft layer 3 performs a displacement movement. In the case of an even number of reciprocal movements, the floats are either on the left border or the right border of the fabric. With an odd number of reciprocal movements, the floats alternate from one side to the other.

Figure 2:
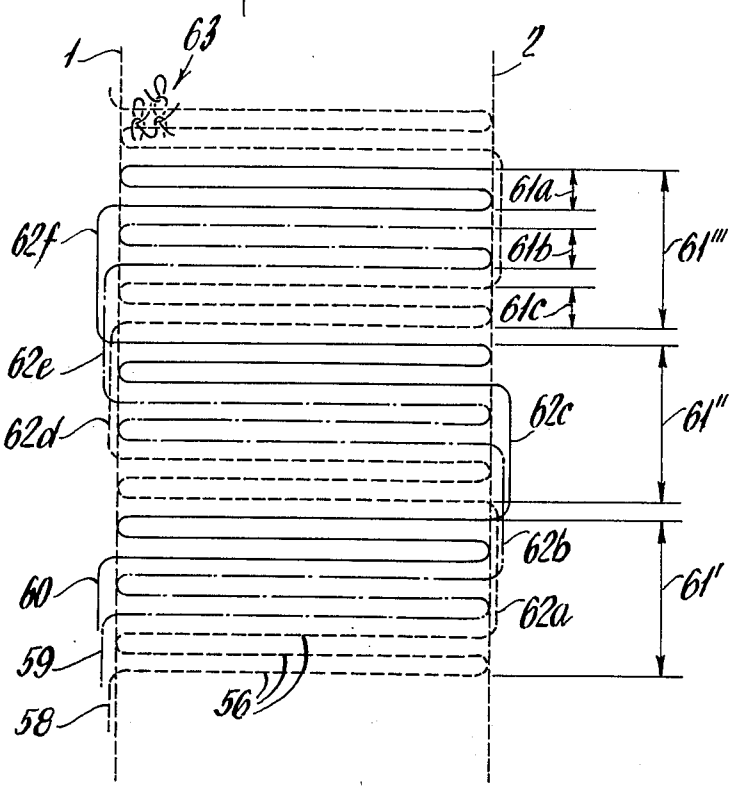
FIG. 2 is a schematic plan view of the fabric.

In the warp knit, particularly tricot knit, fabric of FIG. 2, parallel wefts 58, 59, 60 are laid substantially transversely to the length of the fabric. Weft portions 61*a*, 61*b*, 61*c* of the individual weft sections 61 are endless. Both knitting borders are provided with weft floats 62*a*, 62*b*, 62*c*, 62*d*, 62*e* and 62*f*. The weft floats continuing from weft section 61′ to weft section 61″ to weft section 61‴ are arranged alternately on the right border and the left border of the fabric. The knitting combining the weft lines 56 is a simple tricot knitting 63. While during the laying according to FIG. 1 the weft layer 3 travels six times back and forth between the feeding means 1, 2, the apparatus for the production of the warp knit fabric of FIG. 2 was so adjusted that the weft layer 3 moves only three times back and forth per weft section 61 but carries three wefts 58, 59, 60. As a result of these differences, the weft floats 62*a*, *b*, *c*, *d*, *e*, *f*, alternate from one border to the other and their are three weft portions 61*a*, 61*b*, 61*c* per section 61 compared to two weft portions 54*a*, 54*b* in FIG. 1.

Figure 4:
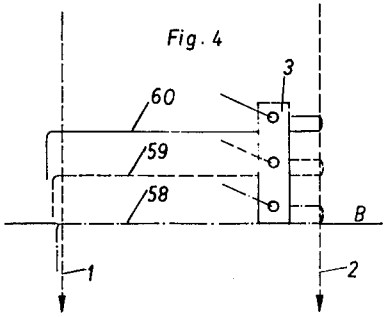
FIGS. 3 to 10 are schematic representations of the individual steps by which the fabric of FIG. 2 is produced.
Figure 6:
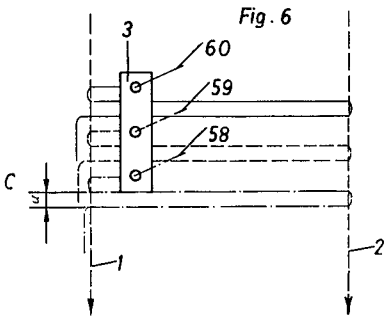
Figure 3:
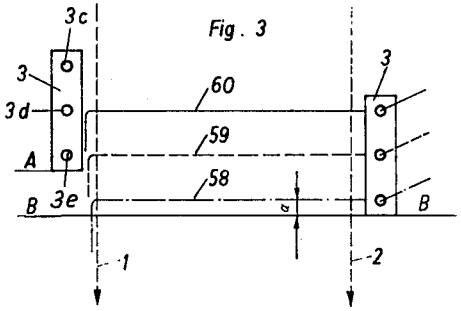
Figure 5:
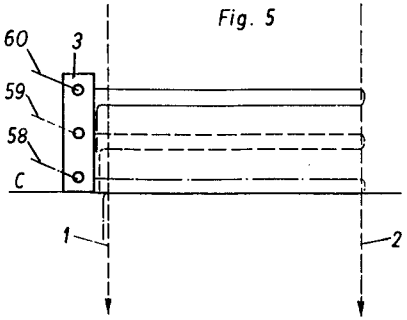
Figure 8:
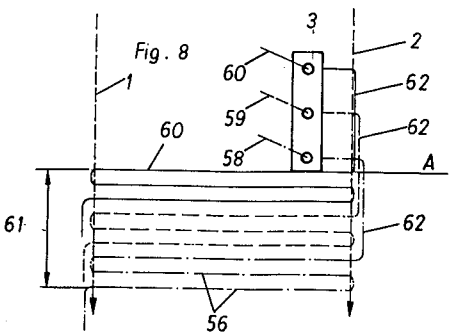
Figure 7:
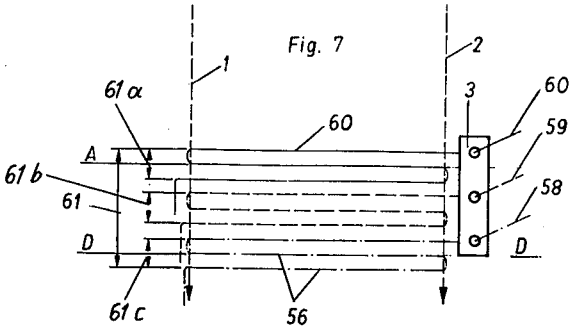
Figure 10:
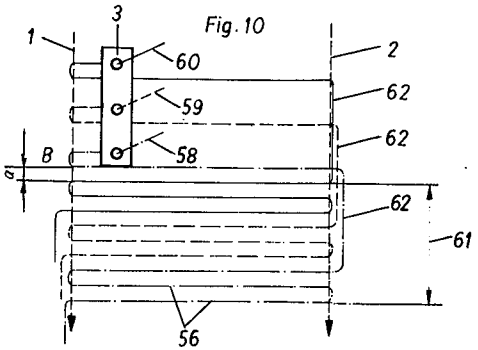
Figure 9:
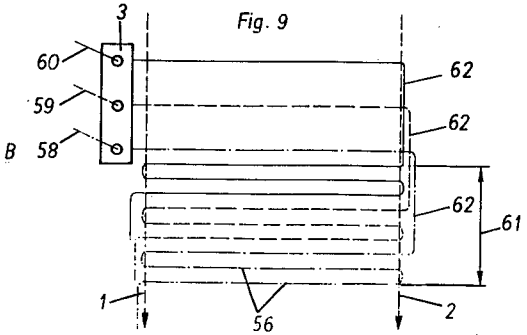

In FIGS. 3 to 10 are illustrated the principal steps in the production of the fabric of FIG. 2. In FIG. 3, the weft layer 3 is in starting position A. The weft layer 3 is provided with eyelets 3*c*, 3*d*, 3*e* for receiving the wefts 58, 59, 60. The feeding means 1, 2 are provided to hold the wefts 58, 59, 60 in positions extended across the width of the machine. The weft layer 3 starts its movement in the direction toward the feeding means 2. Before the weft layer 3 passes the feeding means 1, it is coupled with the feeding means 1, 2. Thus, the weft layer 3 moves not only transversely to the feeding means 1, 2 but also in the direction of motion of the feeding means 1, 2, which results in a position B for the weft layer 3 when the weft layer 3 reaches the feeding means 2. Due to the coupling of the weft layer 3 with the feeding means 1, 2, the wefts 58, 59, 60 are laid at right angles to the feeding means 1, 2. When the weft layer 3 has reached the feeding means 2, the coupling of the weft layer 3 with the feeding means 1, 2 is disengaged. Forward movement of the weft layer 3 is, thus, interupted, with the effect that the feeding means 1, 2 overtake weft layer 3 by one thread interval (FIG. 4). Before the start of the return movement in the direction of the feeding means 1, the weft layer 3 and the feeding means 1, 2 are again operatively connected. As shown in FIG. 5, the weft layer 3 assumes a position C when it is disengaged from the feeding means 1, 2. In a repetition of the coupling operation and of the transverse movement of the weft layer 3, the weft layer 3 can complete a weft section 61 (FIGS. 6 and 7) and the weft layer 3 assumes the forwardmost position D. The next step is the displacement of the weft layer 3 to an extent which insures connection of the weft 58 to the weft 60 (FIG. 8). The weft layer 3 now again assumes its starting position A but in the vicinity of the feeding means 2. FIGS. 9 and 10 illustrate the repeatability of the steps explained in FIGS. 3 to 8. The letter *a* in FIG. 10 indicates a thread interval which is obtained by the forward movement of the feeding means 1, 2 when they overtake the weft layer 3.

Figure 11:
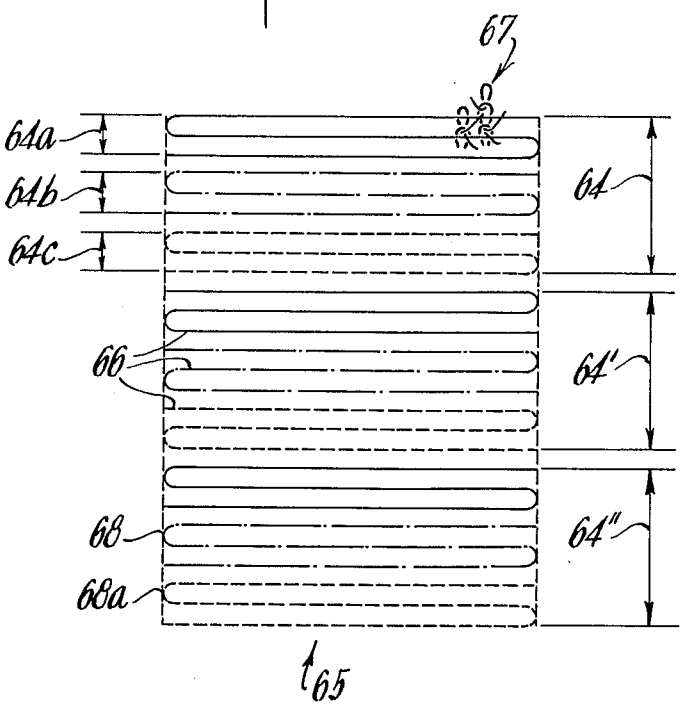
FIG. 11 is a fabric similar to FIG. 2 but with a finite number of weft portions per section.

In FIG. 11 is illustrated a warp knit fabric the weft sections 64, 64′, 64″ of which are arranged loosely side-by-side in a thread interval. The weft portions 64*a*, 64*b*, 64*c* of each section 64 are finite. Exactly as in the warp knit fabric of FIG. 2, the weft layer 3 has moved back and forth three times to produce a section 64. For this embodiment, the eyelets 3*c*, 3*d*, 3*e* would be spaced by three thread intervals of the completed warp knit fabric. The weft sections 64, 64′, 64″ together form the entire weft construction 65 of the fabric. The weft lines 66 of the weft portions 64*a*, 64*b*, 64*c* are held in place by means of simple tricot knitting 67 of which, for the sake of simplicity, only a few stitches are illustrated. In the illustrated embodiment, the ends of the weft portions 64*a*, 64*b*, 64*c*, etc. are provided on both borders of the fabric. The same principles apply to this fabric structure as to the fabric structure of FIG. 2. The elimination of the weft floats is achieved by cutting the wefts to form simple U-shaped configurations 68*a*, 68*b*, 68*c*, etc. Before the wefts are cut, they are clamped by feeding means 1 or 2 (FIG. 12). FIG. 12 is a section through the eyelet 3*a* of the apparatus of FIG. 1 in which the section line is perpendicular to the feeding means 1 and 2.

The feeding means 1, 2 are provided with clamps 69 in the required number. Only one clamp 69 is shown in FIG. 12 and in the related FIG. 13 in order to illustrate the principle. Of course, the feeding means 2 are provided with like clamps. After the weft 9 has been clamped by the feeding means 1 and weft layer 3 has passed the feeding means 1, the weft layer 3 also clamps the weft 9 by means of a clamp 70 provided on the weft layer 3. Then, a cutting blade 71 cuts weft 9. For its closing action the clamp 69 is provided with a spring 72 and for its opening action the clamp 69 is provided with a stop cam 73. Whenever the weft layer 3 passes feeding means 1, clamps 69 and 70 are in the open position and both are closed shortly thereafter. For its closing action, the clamp 70 is provided with a revolving circular eccentric 74 and for its opening action the clamp 70 is provided with a spring 75. When the weft 9 is cut, the displacement of the weft layer 3 can take place. The free thread end of the weft is then again clamped by the feeding means 1 at another point. The clamp 70, however, releases the weft again at this time. The above described cycle is repeated after the next weft section has been formed.

What is claimed is:

1. A method for the production of a warp knit fabric comprising an array of weft threads in the form of repeating sections, each section comprising a plurality of discrete portions of weft thread, each discrete portion extending in a continuous line at least twice from one lateral border of the fabric to the other lateral border of the fabric and forming a U at at least one of the borders of the fabric, the fabric further comprising a plurality of chains of warp knit stitches holding the weft threads together, the method comprising guiding the weft threads through a weft layer which mutually spaces the weft threads by a distance corresponding to at least twice the distance between two adjacent weft threads of the fabric being produced, advancing two spaced, substantially parallel feeding means having means for retaining the weft threads in a direction toward means for forming chains of warp knit stitches in a direction substantially parallel to the feeding means, reciprocating the weft layer and, therewith, the weft threads from one feeding means to the other substantially transversely to the direction of movement of the feeding means, forming each weft portion by carrying out at least once the cycle of moving the weft layer substantially transversely to the direction of movement of the feeding means from a position in proximity to one of the feeding means toward the other feeding means while the weft layer is operatively connected to said feeding means so that the weft layer moves with said feeding means, when the weft layer reaches said other feeding means operatively disconnecting the weft layer from the feeding means and thereby permitting the feeding means to overtake the weft layer by a distance corresponding to the distance between two adjacent weft threads of the fabric being produced, again operatively connecting the weft layer to the feeding means, moving the weft layer substantially transversely to the direction of movement of the feeding means toward said one feeding means, when the weft layer reaches said one feeding means operatively disconnecting the weft layer from the feeding means and thereby permitting the feeding means to overtake the weft layer by a distance corresponding to the distance between two adjacent weft threads of the fabric being produced, whereby upon each reversal of the direction of the motion of the weft layer the weft threads are formed into U-shaped configurations, continuing the formation of these configurations until the spaces between the individual weft threads are filled whereby a weft section is formed, displacing the weft layer opposite to the direction of motion of the feeding means a distance such that upon reciprocation of the weft layer in its thereby attained new position the weft thread thereby laid in a position most advanced relative to the direction of travel of the feeding means is adjacent to and spaced from the weft thread of the formerly laid weft threads least advanced relative to the direction of travel of the feeding means by the same distance as the distance between two adjacent weft threads of the fabric being produced and repeating the sequence of steps to form adjoining sections.

2. A method according to claim 1, in which the weft layer is caused to traverse between feeding means an even number of times between weft portion and weft section of the weft array.

3. A method according to claim 1, in which the weft layer is caused to traverse between feeding means an odd number of times per weft portion and per weft section of the weft array.

4. A method according to claim 1, further comprising clamping each weft thread after it is formed into a U-shaped configuration and before the weft layer is displaced in a direction opposite to the direction of motion of the feeding means, the clamping being effected by the feeding means adjacent the U-shaped configuration and by means of the weft layer, then cutting the weft thread, then displacing the weft layer in a direction opposite to the direction of motion of the feeding means, then again clamping the weft thread but only by means of the feeding means, then feeding the weft thread to the other feeding means to again form a U-shaped configuration, repeating the clamping and cutting steps but now at said other feeding means, and repeating the sequence of steps.

5. Apparatus for carrying out a method comprising guiding weft threads through a weft layer, advancing two spaced, substantially parallel feeding means having means for retaining the weft threads in a direction toward means for forming chains of warp knit stitches in a direction substantially parallel to the feeding means, reciprocating the weft layer and, therewith, the weft threads from one feeding means to the other substantially transversely to the direction of movement of the feeding means, forming each weft portion by transporting the weft threads with the weft layer from one feeding means to another at least twice whereby upon each reversal of the direction of the motion of the weft layer, the weft threads are formed into U-shaped configurations, continuing the formation of these configurations until the spaces between the individual weft threads are filled whereby a weft section is formed and repeating the sequence of steps to form adjoining sections, the apparatus comprising two spaced, substantially parallel feeding means, a weft layer, means for reciprocating the weft layer between the feeding means and for moving the weft layer in directions parallel to the feeding means, the weft layer being provided with a plurality of weft thread guide means arranged along a line substantially parallel to the feeding means and mutually spaced by a distance corresponding to at least twice the distance between two adjacent wefts of the fabric to be produced by the apparatus, means for forming chains of warp knit stitches substantially parallel to the feeding means for holding the weft threads together, means for coupling the weft layer with the feeding means during the reciprocation of the weft layer for causing the weft layer to move with the feeding means toward the warp knitting means, means for decoupling the weft layer from the feeding means between each reciprocating movement thereby to permit the feeding means to overtake the weft layer by a distance corresponding to the distance between two adjacent weft threads of the fabric to be produced, and means for displacing the weft layer opposite to the direction of motion of the feeding means a distance such that upon reciprocation of the weft layer in its thereby attained new position the weft thread thereby laid in a position most advanced relative to the direction of travel of the feeding means is adjacent to and spaced from the weft thread of the formerly laid weft threads least advanced relative to the direction of travel of the feeding means by the same distance as the distance between two adjacent weft threads of the fabric to be produced.

6. Apparatus according to claim 5, in which the coupling and decoupling means comprise a bar secured to the weft layer transversely to the feeding means, freely rotationally mounted on the bar adjacent respective ends of the bar a pair of sprocket wheels and adjacent each of the sprocket wheels a respective magneto coupling actuatable to secure the respective sprocket wheels against rotation.

7. Apparatus according to claim 6, further comprising respective tackles adjacent each of the ends of the bar, adjacent each of the tackles a respective angle lever, each tackle being connected at one end to a respective end of the bar and at the other end to a respective angle lever.

8. Apparatus according to claim 7, further comprising adjacent each angle lever a respective endless chain having a cam mounted thereon, means, including driven sprocket wheels, for driving each of said chains so that the cam mounted thereon engages and pivots a respective one of the angle levers.

9. Apparatus according to claim 6, in which connected to each of the feeding means parallel thereto is a chain positioned to be engaged by a respective one of the sprocket wheels.

10. Apparatus according to claim 5, further comprising weft clamping means and weft cutting means mounted on the feeding means.

11. Apparatus according to claim 10, further comprising weft clamping means mounted on the weft layer.

* * * * *